US009679459B2

(12) United States Patent
Crowe

(10) Patent No.: US 9,679,459 B2
(45) Date of Patent: Jun. 13, 2017

(54) DISTRACTING MODULE SYSTEM

(71) Applicant: Crotega, LLC, Crystal, MN (US)

(72) Inventor: Jody Allen Crowe, Crystal, MN (US)

(73) Assignee: CROTEGA, LLC, Crystal, MN (US)

( * ) Notice: Subject to any disclaimer, the term of this patent is extended or adjusted under 35 U.S.C. 154(b) by 0 days.

(21) Appl. No.: 15/144,195

(22) Filed: May 2, 2016

(65) Prior Publication Data

US 2016/0247374 A1 Aug. 25, 2016

Related U.S. Application Data

(63) Continuation-in-part of application No. 14/475,516, filed on Sep. 2, 2014.

(51) Int. Cl.
*G08B 15/02* (2006.01)
*G08B 13/16* (2006.01)

(52) U.S. Cl.
CPC ..... *G08B 15/02* (2013.01); *G08B 13/1672* (2013.01)

(58) Field of Classification Search
CPC ..... G08B 15/00; G08B 15/02; G08B 15/004; G08B 19/005; G08B 13/22; G08B 13/1672; A62C 99/072; A62C 35/026; A62C 35/68
See application file for complete search history.

(56) References Cited

U.S. PATENT DOCUMENTS 5,796,330 A * 8/1998 Vinette ..... G08B 15/02 109/29
5,819,124 A * 10/1998 Somner ..... G08B 13/19632 396/263
6,296,808 B1 10/2001 Pearman
8,196,064 B2 6/2012 Krzyzanowski et al.
8,303,905 B2 11/2012 Brents et al.
2002/0131265 A1* 9/2002 Cilia ..... B05B 17/08 362/101
2003/0168225 A1* 9/2003 Denne ..... A62C 35/023 169/46
2008/0111687 A1 5/2008 Husmann
2010/0264217 A1* 10/2010 Kumhyr ..... G08B 15/02 235/400
2011/0265880 A1 11/2011 Kirn
2012/0092163 A1 4/2012 Hart
2012/0296476 A1 11/2012 Cale et al.

FOREIGN PATENT DOCUMENTS

EP 1433149 A 6/2004

OTHER PUBLICATIONS

"Preventing School Shootings, a Summary of a U.S. Secret Service Safe School Initiative Report", NIJ Journal, No. 248, pp. 11-15, 2002.

* cited by examiner

*Primary Examiner* — An T Nguyen
(74) *Attorney, Agent, or Firm* — Global IP Counselors, LLP

(57) ABSTRACT

A distracting module system includes a hydro pneumatic solution tank, a valve, a nozzle, a controller and a detecting system. The controller is programmed to receive a sensor alert signal from the detecting system and send an activation signal to the valve to regulate and control fluid movement from the hydro pneumatic solution tank through the valve and to the nozzle, and to deliver information related to the sensor alert signal and the activation signal to third party devices.

20 Claims, 6 Drawing Sheets

DISTRACTING MODULE SYSTEM

CROSS-REFERENCE TO RELATED APPLICATIONS

This application is a continuation-in-part of U.S. patent application Ser. No. 14/475,516 filed on Sep. 2, 2014. The entire disclosure of U.S. patent application Ser. No. 14/475,516 is hereby incorporated herein by reference.

BACKGROUND

Field of the Invention

This invention relates to a distracting system to deter, delay and distract intruders from causing damage or harm upon entering and roaming buildings.

Background Information

Many buildings have systems to suppress fires until the fire department arrives. Many conventional systems that suppress fires are heat activated. These systems are generally connected to a water supply system.

Additionally, conventional security alarms exist in which a visual or auditory alarm is issued when an intruder is detected.

SUMMARY

It has been determined that conventional fire suppression systems and security alarms are not capable of suppressing active shooters who breech protected or unprotected entrances or who become active when inside buildings. The unprotected interior of buildings enables an active shooter or any violent perpetrator unfettered access to victims. In such circumstances, a veritable 'reign of terror' can occur until the perpetrator is confronted by someone who risks their life, by law enforcement, or the perpetrator chooses to desist. The present invention provides a non-lethal defensive system to deter, distract, and delay threats inside of a building, public or private, commercial or home, until law enforcement arrives.

Accordingly, a distracting module system accordingly to an embodiment of the present invention comprises a tank, a valve, a nozzle, a detecting system and a controller. The tank has a top, a bottom, a fluid inlet valve configured to enable fluid to be injected into or released from the tank, a gas inlet valve configured to enable compressed gas to be injected into the tank so as to form a compressed gas cushion, and a gas relief valve configured to enable release of the compressed gas from the tank. The valve is in fluid communication with the tank. The nozzle is in fluid communication with the valve. The detecting system is configured to generate a sensor alert signal. The controller is programmed to control the valve, to receive the sensor alert signal from the detecting system and send an activation signal to the valve to regulate and control fluid movement through the valve and to the nozzle, and to deliver information related to the sensor alert signal and the activation signal to third party devices.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained with reference to the drawings. It will be apparent to those skilled in the art from this disclosure that the following descriptions of the embodiments are for illustration only and not for the purpose of limiting the invention as defined by the appended claims and their equivalents.

Figure 1:
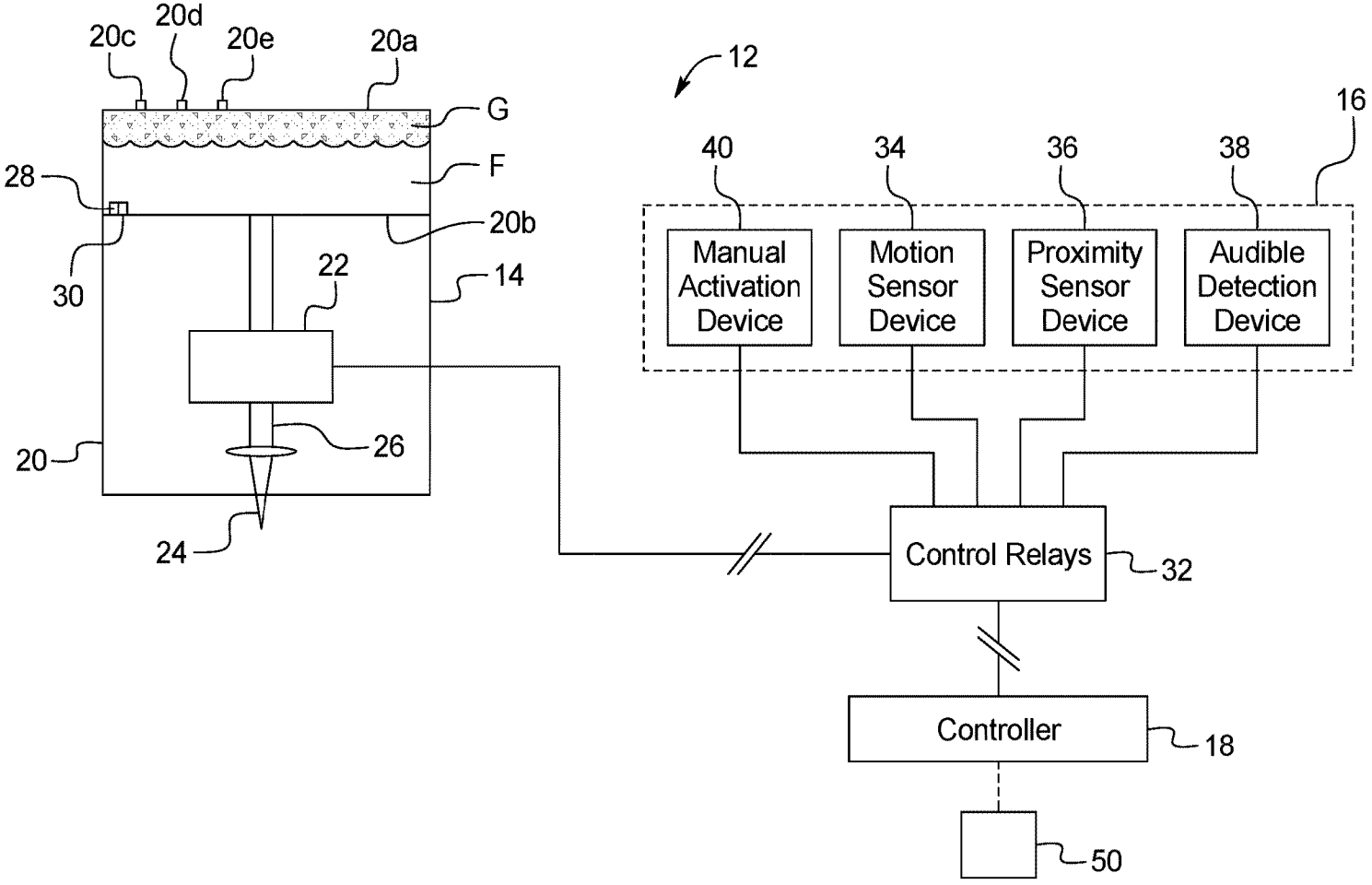
FIG. 1 illustrates an embodiment of a distracting module system using compressed gas to generate pressure in a tank with one valve and one nozzle.
Figure 2:
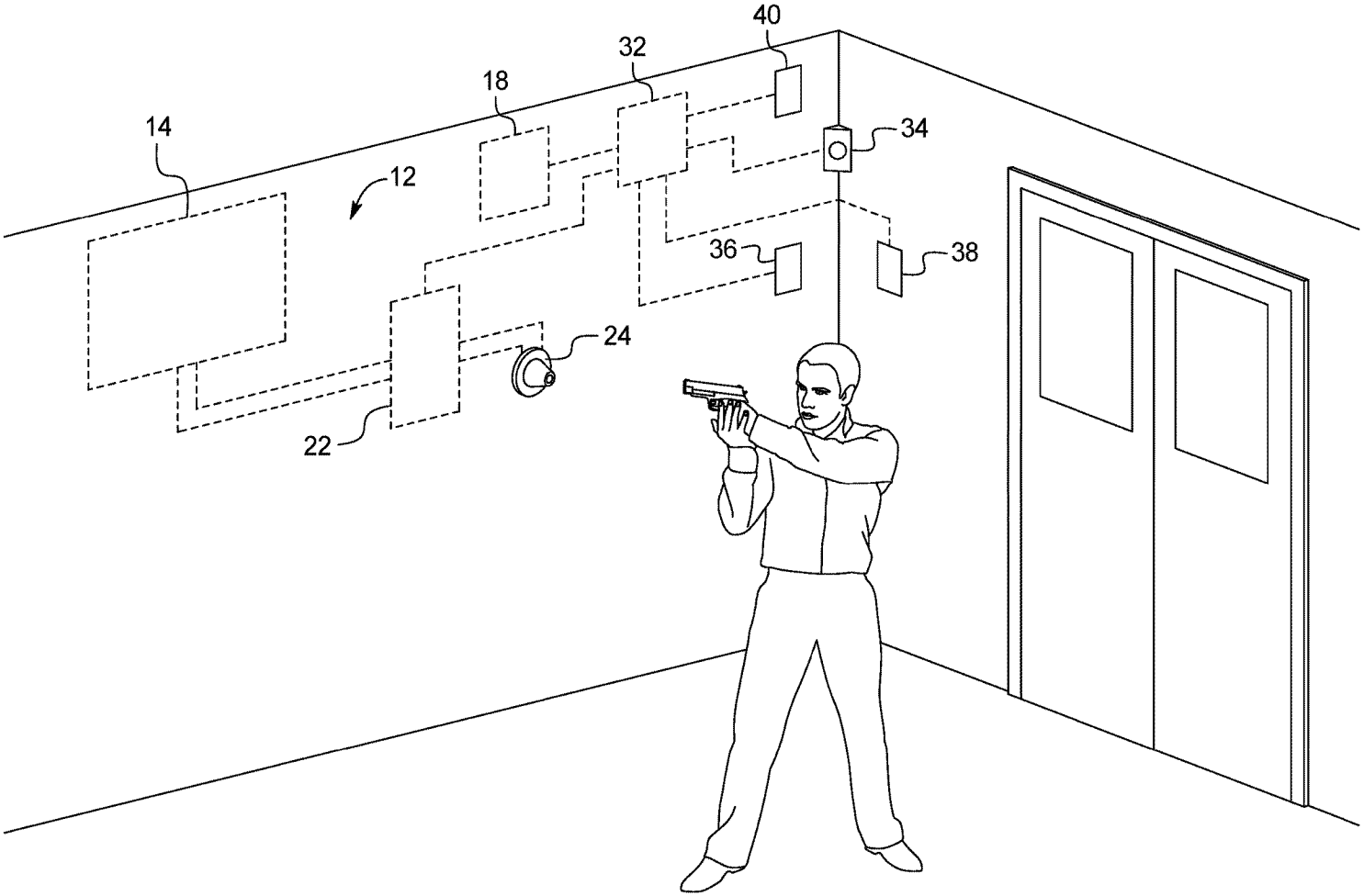
FIG. 2 illustrates an intruder entering an area with the distracting module system of FIG. 1.
Figure 3:
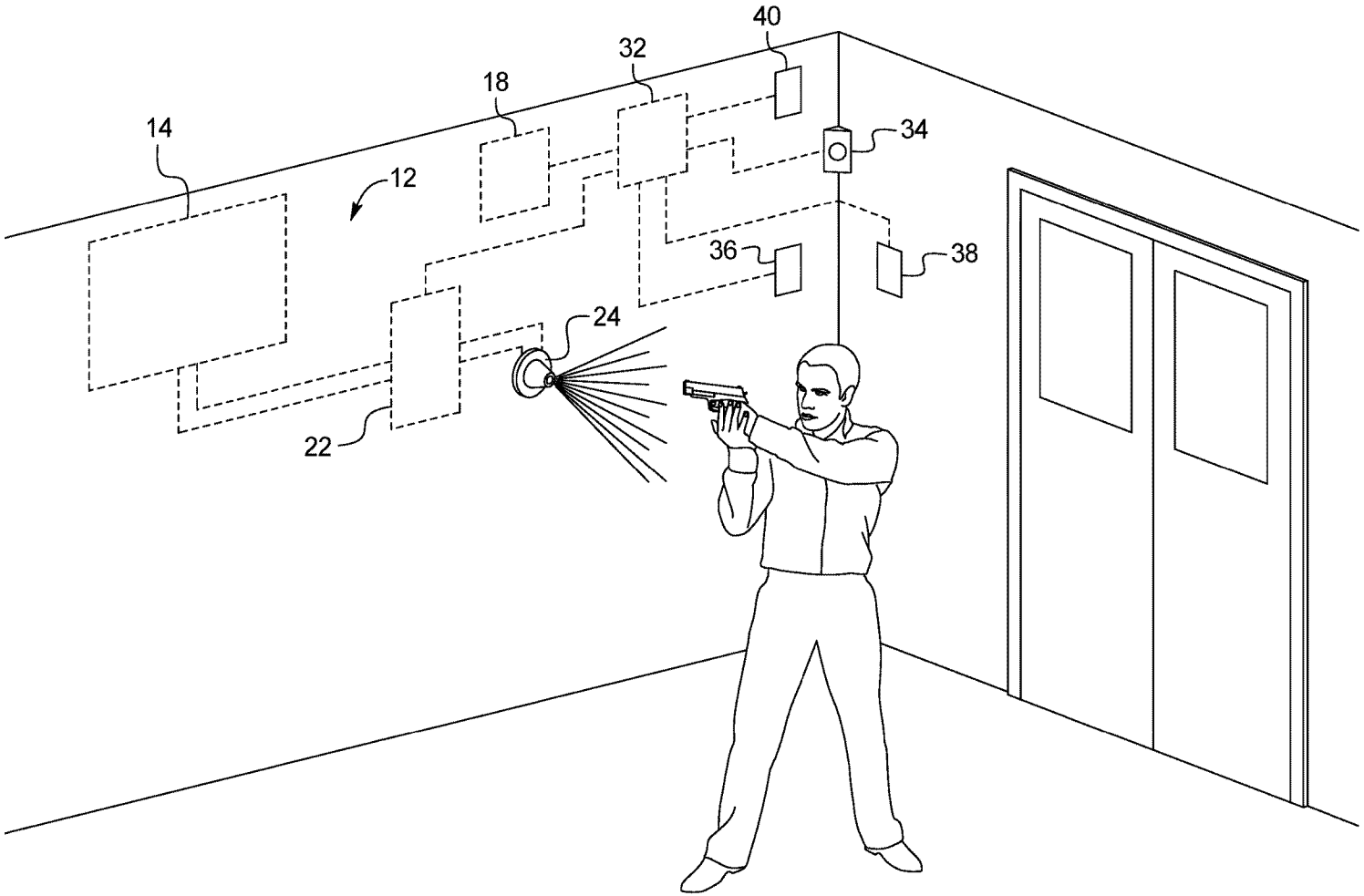
FIG. 3 illustrates the distracting module system of FIG. 1 with fluid being dispensed though the nozzle of the distracting module system of FIG. 1.

Referring initially to FIGS. 1 and 2, a distracting module system 12 is illustrated in accordance with an embodiment. The distracting module system 12 includes a module 14, a detecting system 16 and a controller 18.

The module 14 can be self-contained and includes a tank 20, a valve 22 and a nozzle 24. In other words, the distracting module system 12 can be a stand-alone system, with the module 14 independent from the building water/fluid supply systems. The module 14 is preferably electrically coupled to the controller 18 and can be controlled thereby, as discussed below.

The tank 14*a* can be a hydro pneumatic solution tank, and includes a top 20*a*, a bottom 20*b*, a fluid valve 20*c* configured to enable fluid F to be injected into or released from the tank 20, a compressed gas inlet valve 20*c* configured to enable compressed gas G to be injected into the tank 20 so as to form a compressed gas cushion, and a compressed gas relief valve 20*e* configured to enable release of the compressed gas G from the tank 20. As is understood, when compressed gas G is injected into the tank 20, the compressed gas G will exert pressure on fluid F contained within the tank 20.

The valve 22 can be a controlled area valve 22, and is in fluid communication with the tank 20. The valve 22 can be any suitable valve that can prohibit the pressurized fluid F from exiting the tank 20 and/or unintentionally passing through the nozzle 24. The valve 22 can be manually or automatically (e.g., computer controller 18) opened. If desired, the valve 22 can be opened or closed in any suitable manner to prevent over pressurization of the system and tank 20.

The nozzle 24 can be a directional nozzle and can be in fluid communication with the valve 22 through a nozzle outlet 26, which can be disposed proximate to the bottom 20*b* of the tank 20. The nozzle 24 can be any suitable nozzle capable of spraying the fluid F in a predetermined direction and cover a predetermined spray area. In one embodiment, the nozzle direction can be altered or changed to enable the nozzle 24 to be directed to a specific area. The change in nozzle direction can be manual or computer controlled.

In one embodiment, module 14 for the distracting module system 12 can include a pressure indicator 28 in fluid communication with the tank 20, and a pressure switch 30 in fluid communication with the tank 20.

The controller 18 (central processing computer) can be in electronic communication with the valve 22, the detection system 16, and the pressure switch 30 via a hard wired or a wireless Local Area Network, or any other suitable communication system. The controller 18 preferably includes a microcomputer with a control program that controls the valve as discussed below. The controller 18 can also include other conventional components such as an input interface circuit, an output interface circuit, and storage devices such as a ROM (Read Only Memory) device and a RAM (Random Access Memory) device. The microcomputer of the controller 18 is programmed to control the valve 22, the detection system 16, and the pressure switch 30. The memory circuit stores processing results and control programs such as ones for the valve 22, the detection system 16, and the pressure switch 30 operation that are run by the processor circuit. The controller 18 is operatively coupled to the valve 22, the detection system 16, and the pressure switch 30 in a conventional manner. The internal RAM of the controller 18 stores statuses of operational flags and various control data. The controller 18 is capable of selectively controlling any of the components of the distracting module system 12 in accordance with the control program. It will be apparent to those skilled in the art from this disclosure that the precise structure and algorithms for the controller 18 can be any combination of hardware and software that will carry out the functions of the present invention.

The controller 18 is preferably electrically couples to relay board with a control relay 32. The controller 18 can be in electronic communication relay board via hard wired or wireless Local Area Network, and the detection system 12 located proximate to the distracting module system 12.

The detecting system 16 can include a motion sensor device 34 and/or a proximity sensor device 36 and/or an audible noise detection device 38 and/or a manual activation device 40. The motion sensor device 34 can be any suitable device that is configured to or capable of sensing motion. For example, the motion sensor device 34 operate using passive infrared (PIR), microwaves, ultrasonic waves and video camera software, or any other suitable technology.

Passive infrared sensors are sensitive to a person's skin temperature through emitted black body radiation at mid-infrared wavelengths, in contrast to background objects at room temperature. No energy is emitted from the sensor, thus the name "passive infrared" (PIR).

Microwave motion detectors detect motion through the principle of Doppler radar, and are similar to a radar speed gun. A continuous wave of microwave radiation is emitted, and phase shifts in the reflected microwaves due to motion of an object toward (or away from) the receiver result in a heterodyne signal at low audio frequencies.

Ultrasonic detectors use an ultrasonic wave (sound at a frequency higher than a human ear can hear) is emitted and reflections from nearby objects are received. Similar to Doppler radar, heterodyne detection of the received field indicates motion. The detected doppler shift is also at low audio frequencies (for walking speeds) since the ultrasonic wavelength of around a centimeter is similar to the wavelengths used in microwave motion detectors.

Video cameras can be used to detect motion from the output of the camera. This solution is particularly attractive when the intention was to record video triggered by motion detection, as no hardware beyond the camera and computer is required.

Accordingly, when an intruder is moving in an undesired area, the motion sensor device 34 can sense motion and transmit a signal to the controller 18 that undesired movement is occurring in a location.

The proximity sensor device 36 can be any sensor capable to detecting the presence of nearby objects without any physical contact. For example, the proximity sensor device 36 can emit an electromagnetic signal or a beam of electromagnetic radiation (e.g., infrared) into the field and detect a change in the return signal.

The manual activation device 40 can be any manual device in the proximity of the distracting module system 12 or in any other position. For example, the manual activation device 40 can be a button, lever or any other suitable activation device that would enable manual activation of the distracting module system 12. The manual activation device 40 can be located within eyesight of the location of the module 14. The manual activation device 40 can be connected to the controller 18 (central processing computer) via a hardwired or wireless Local Area Network.

The audible noise detection device 38 can be a gunshot detection activation system or any other suitable device. That is, the audible noise detection device 38 can be configured to determine when a gunshot has occurred and send a signal to the controller 18 indicating that a gunshot has occurred. The audible noise detection device 38 detects the location of gunfire or other weapon fire using acoustic, optical, or other suitable sensors, or a combination of such sensors.

The detecting system 16 can be connected to the control relay 32, which is, in turn, connected to the controller 18. The controller 18, upon receiving a signal from any sensor or device in the detection system 12, using the logic built into the software, sends a signal to the control relay 32, causing the valve 22 or valves 22 in the module 14 to open, which sends the cold water through the nozzles 24 in the module 14. The various designs of nozzles 24 distribute the pressurized water in a pattern designed for maximum coverage.

Thus, the controller 18 comprises a sensor recognition and signal activation software application system for receiving and recognizing sensor alerts from the detecting system 16 and for sending activation signals to the valve to regulate and control fluid movement through the valve 22 and to the nozzle 24.

In other words, the distracting module system 12 can be activated by visual observation of an intruder, by an audible noise detection device 38, such as a gunshot detection activation system, or by the presence of an intruder via a proximity sensor device 36 and/or a motion sensor device 34.

Figure 5:
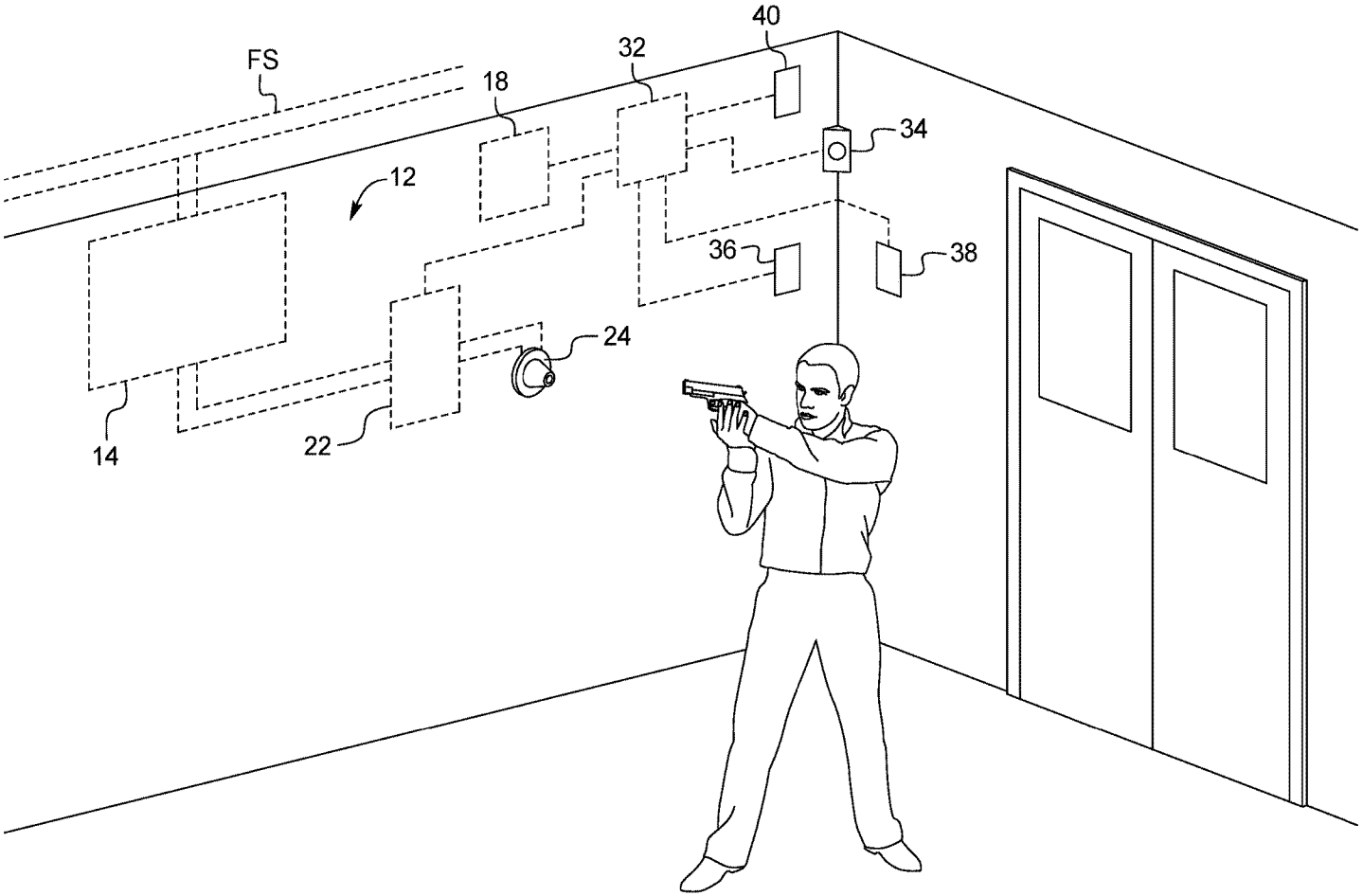
FIG. 5 illustrates an embodiment of the distracting module system of FIG. 1 connected to the water system (e.g., sprinkler system) of the building.

Thus, as is understood, the distracting module system 12 can use pressurized fluid F (e.g., cold water) delivered through a nozzle 24 as a shield to deter, delay, and distract violent perpetrators inside of a building. The distracting module system 12 is preferably a stand-alone distracting module system 12 with a tank 20 having pressurized gas G therein to cause the fluid F to be dispersed through the nozzle 24. However, the distracting module system 12 can utilize the building fire suppression sprinkler water delivery system for cold water delivery to the nozzles 24, as shown in FIG. 5. The fluid F, optionally infused with an eye or throat irritant or a forensic dye agent or both, can become a distracting and defensive shield when the system is activated. System activation can occur when a detecting system 16 detects a gunshot or undesired movement or presence of an intruder and/or by manual activation by building occupants upon visual recognition of a threat by the building occupants.

Figure 4:
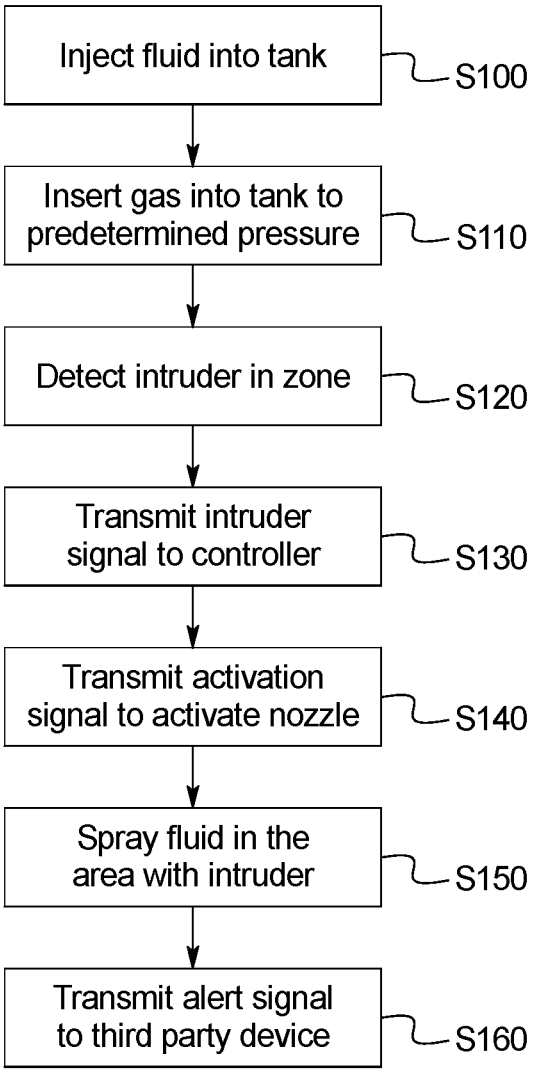
FIG. 4 illustrates a method of operating the distracting module system of FIG. 1.

FIG. 4 is a flow chart illustrating the method of operation of an embodiment of the distracting module system 12. In step S100, a fluid F is injected into the tank 20 through the fluid valve 20*c*, and in step S110 a gas G is inserted into the tank 20 through gas inlet valve 20*c*. The gas G causes the tank 20 to be under a predetermined pressure that would enable pressure release of the fluid F. The predetermined pressure can be monitored via the pressure indicator 28. In step S120, the detecting system 16 detects the presence of an intruder in a zone. As described herein, the detection of the intruder can be accomplished by any one of or combination of a motion sensor 34, a proximity sensor 36, an audible sensor 38 or manual activation of the manual activation device 40, or any other suitable device.

In step S130, an intruder signal is transmitted from the detecting system 16 to the controller 18. The controller 18, in step S140, then sends an activation signal to activate the nozzle 24 in the proper zone to spray the intruder with the fluid F disposed in the tank 20, so as to spray fluid F into the zone with the intruder in step S150. In step S160, the controller 18 transmits an intruder alert signal to the appropriate third party device 50 (preferably simultaneously with the transmission of the activation signal). For example, the controller 18 can send an intruder signal to the local police department, a building security office, a building administration office, a mobile device, or any other desired location or device.

As illustrated in FIG. 5, another embodiment can have the fluid inlet valve 20*d* in fluid communication with a fire sprinkler system FS of the building or in fluid communication with a domestic water supply system of the building.

In this embodiment, all plumbing is performed using materials consistent with local codes. The valve 22 is plumbed into the fire sprinkler water supply system in a manner that does not impede the operation of the fire sprinkler system FS. The valve 22 is wired into the control relay 32. A power supply plugged into a building outlet provides the electrical current to the control relay to power the valve 22. The control relays 32 are connected to the controller 18 via hard wired or wireless Local Area Network.

When the valves 22 deploy in a fire sprinkler system module, the distracting module system 12 can work in conjunction with the fire sprinkler system water flow which would automatically set off the fire alarm. In this configuration, the controller 18 can issue a lock-down alarm in conjunction with the alarm set off by the fire sprinkler system. Building occupants can be trained to adjust to the lock-down announcement. Alternatively, a signal from the controller 18 can transfer the alarm from a fire alarm to a lock-down alarm. This configuration can be contingent upon local codes and local fire alarm capability to transfer the alarm from a fire alarm to a lock-down alarm.

Figure 6:
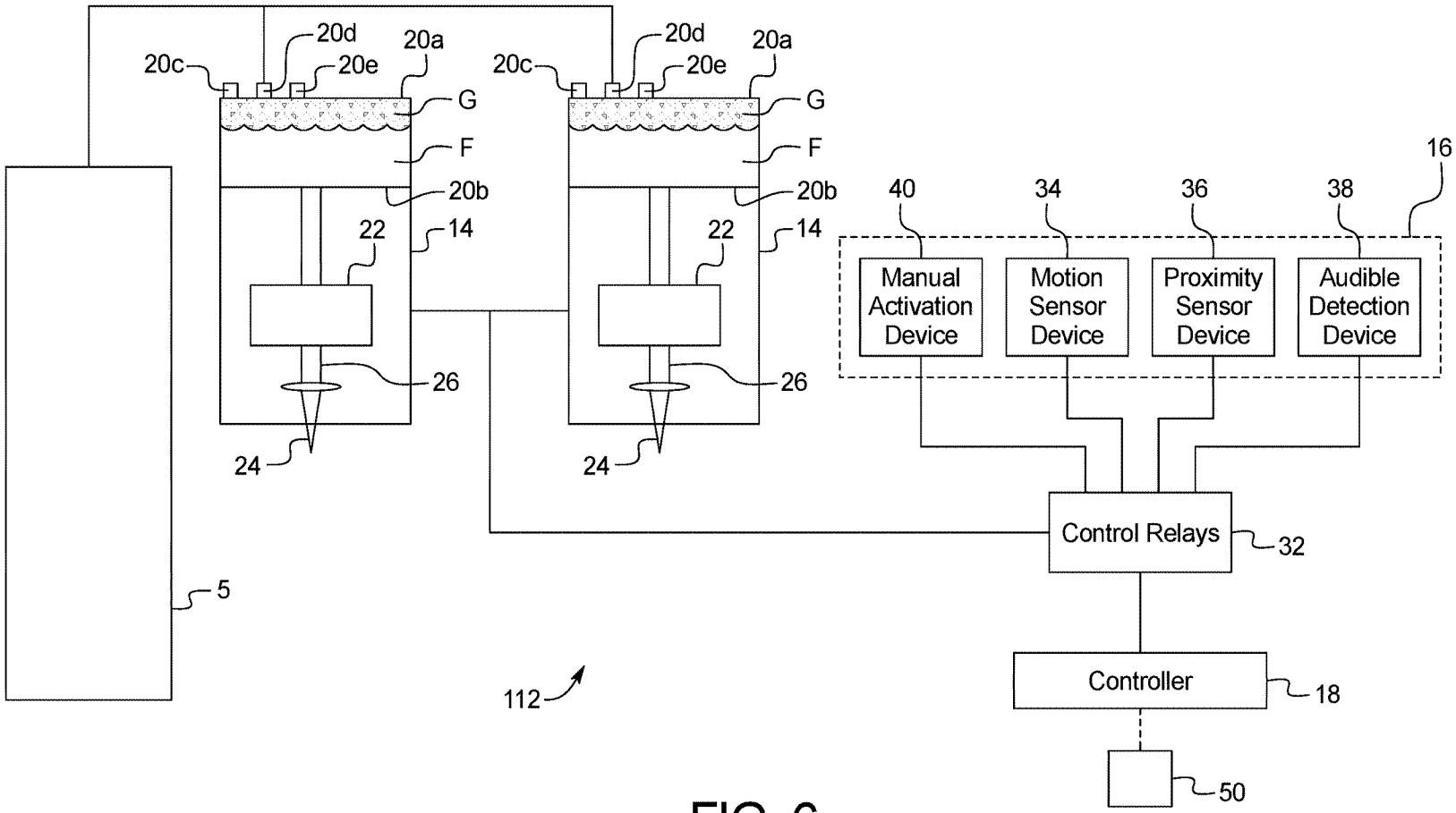
FIG. 6 illustrates an embodiment using compressed gas to generate pressure in a plurality of tanks with multiple valves and multiple nozzles.

Further, as shown in FIG. 6, a second embodiment of a distracting module system 112 is shown. The elements that are similar to the embodiments above are indicated with the same reference numerals, and a description thereof will not necessarily be repeated herein.

The distracting module system 112 can include more than one module 14 operating together. Similarly to the system discussed above, each module 14 can include tank 20, a valve 22 and a nozzle 24. Each module 14 is preferably electrically coupled to the controller 18 and can be controlled thereby, as discussed above.

Accordingly, in this embodiment, the module 14 can be installed in a variety of entrances, hallways, offices, conference rooms, classrooms, or other areas throughout the building, as determined by the building owner. The detecting system 16 can include a plurality of detecting devices (e.g., a plurality of proximity detector devices 36, a plurality of motion sensor devices 34, a plurality of audible noise detection devices 38, and a plurality of manual activation devices 40) disposed throughout the building to identify and deter an unauthorized occupant or intruder, as described herein. When there is a visual recognition of a threat or of an active shooter, building personnel can utilize at least one of the manual activation devices 40 that are strategically placed throughout the building to arm and activate at least one of the modules 14 in the distracting module system 112. The manual activation devices 40 can be strategically placed throughout the building for quick response by authorized building occupants. A building occupant can visually identify the intruder and the intruder's location, and activate the distracting module system 112 in the desired zone. Upon activation, the manual activation device 40 sends a signal to the controller 18, which then triggers the nozzle(s) 24 in the identified zone, spraying a timed burst of fluid F throughout that zone. One embodiment can have the fluid F (e.g., water) infused with a chemical deterrent, a forensic dye, or the like, for deterring, incapacitating or marking the intruder. Also upon activation, a building-wide lockdown alarm can be sounded and the building occupants can follow lockdown procedures.

Similarly to the tank 20 described above, the tank 20 in the distracting module system 112 can be a hydro pneumatic solution tank, and can include a top 20*a*, a bottom 20*b*, a fluid inlet valve 20*d* configured to enable fluid F to be injected into or released from the tank 20, a compressed gas inlet valve 20*c* configured to enable compressed gas G to be injected into the tank 20 so as to form a compressed gas cushion, and a compressed gas relief valve 20*e* configured to enable release of the compressed gas G from the tank. As is understood, when compressed gas G is injected into the tank 20 the compressed gas G will exert pressure on fluid F contained within the tank 20. The modules 14 can be configured with a compressed gas source linked to one storage tank 5 or multiple pressurized storage tanks filled with fluid F (e.g., water and/or a deterrent agent or agents), one or multiple valves 22, and one or multiple nozzles 24 linked to one or more motion sensor devices 34, one or multiple proximity sensors 36 and/or manual activation devices 40 and/or one or audible noise detection devices 38, and one or multiple relay boards with control relays 32. Each module 14 is connected to the controller 18 (central processing computer) via hard wired or wireless Local Area Network. Each module 14 is designed to provide coverage at one hundred or more square feet per nozzle. Nozzles 24 have various configurations to accommodate multiple facility designs.

As stated above, in this embodiment, the plurality of modules 14 can be disposed in strategic locations for maximum protection, such as entrances, hallways, offices, conference rooms, classrooms, or other areas throughout the building, as determined by the building owner. Further, the audible noise detection devices 38 (e.g., gunshot detection devices) can strategically placed throughout the building for optimum sound (gunshot) location capabilities. When a gunshot occurs at an entrance or within the building, the audible noise detection devices 38 can relay the sound of the gunshot to a gunshot detection peripheral connected to the controller 18. Detection and identification of a gunshot signature by the gunshot detection peripheral immediately provides the location of the intruder within a threatened zone.

The system 12 (system 112) can be configured to require visual recognition of the gunshot threat for activation, or the controller 18 can activate the zone identified as the location where the gunshot occurred, sending a signal to activate the module 14 which sprays a timed burst of cold water throughout that zone. One embodiment can have water infused with a chemical deterrent, a forensic dye, or the like, for deterring, incapacitating or marking the intruder.

Moreover, in one embodiment, the motion sensor devices 34, including e.g., surveillance video motion detection, are disposed so as to be in close proximity to the activated zone and can be immediately armed for immediate recognition of movement. A building-wide lockdown alarm is sounded and the building occupants follow their lockdown procedures.

In another embodiment, a plurality of modules 14 can be installed in strategic locations for maximum protection with emphasis on entrances to a home. The manual activation devices 40 can be strategically placed throughout a home to arm and activate the distracting module system 12 when there is a visual recognition of a threat to the health/life of a member of the family. The manual activation devices 40 can be strategically placed throughout the home for quick response by any member of the family. Upon activation, the manual activation device 40 sends a signal to the controller 18, which then triggers the module 14 in the identified zone; spraying a timed burst of cold (optional deterrent and forensic dye laden) water throughout that zone. Upon activation, an alarm is sent to dispatch law enforcement.

The system is module-based to accommodate any size building. Thus, a building can include the distracting module system 12 with a singe module 14 or the distracting module system 112 with a plurality of modules 14. Any or all plumbing can be performed using materials consistent with local codes.

In another embodiment, the controller 18 can include a software application for delivery of intruder sensor alerts and activation signals information to third party mobile devices 50 and wireless computers, whereby when an intruder is discovered in the building, the intruder's location can be identified by the detection system 12, which can send a signal to the controller 18 activating the module 14, the controller 18 then, receiving and recognizing the location of the intruder through the detection system 12, sends a signal to the valve in the area of the intruder's location to open, resulting in the release of constant pressure on the fluid F contained within the tank 20 created by the compressed gas G, thereby allowing a timed burst of fluid F throughout the intruder's location through the nozzle.

The fluid F in the tank 20 can be non-aeriated cold water, which may be mixed with an irritant and/or at least one deterrent/dye deterrent. In embodiments, in which the module is connected to a fire sprinkler system FS or the domestic water supply, a deterrent/dye metering device, located on the flow side of the valve 22 can be used to ensure non-contamination of the water supply of fire sprinkler system, and/or meter out a calculated amount of agent into the water stream, as the water passes through the piping to the nozzle 24, so as to disperse a forensic dye or a chemical deterrent. However, it is noted that the fluid F can be any suitable material that facilitates deterring an undesirable occupant of a building. Nozzles 24 can be attached to the flow side of the valves 22. The nozzles 24 can be securely affixed in strategic locations in/on the ceiling and walls to ensure optimum coverage and effectiveness for each module 14.

Other embodiments of the distracting module system 12 include a nozzle 24 that is concealed from view of occupants of or intruders in the building in a portion of the building structure such as a ceiling, door frame, or a counter or concealed in an accessory to the building structure, such as a light fixture or hanging pendant.

As stated above, all plumbing can be performed using materials consistent with local codes. Moreover, one embodiment can have the domestic water supply plumbed into the tank 20. The tanks 20 can supply a pressurized volume of water to the valves 22. The valve 22 can be wired into the control relay 32. A power supply plugged into a building outlet can provide the electrical current to the control relay 32 to power the valve 22. The control relays 32 21 are connected to the controller 18 via hard wired or wireless Local Area Network.

Configuration of the distracting module system 12 within buildings can be determined by the building owner.

The distracting module system 12 as described herein provides a non-lethal defensive system to deter, distract, and delay threats inside of a building, public or private, commercial or home, until law enforcement arrives.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "about" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

I claim:

1. A distracting module system comprising:

a tank having a top, a bottom, a fluid valve configured to enable fluid to be injected into or released from the tank, a gas inlet valve configured to enable compressed gas to be injected into the tank so as to form a compressed gas cushion, a gas relief valve configured to enable release of the compressed gas from the tank;

a valve in fluid communication with the tank;

a nozzle in fluid communication with the valve;

a controller programmed to control the valve; and a detecting system configured to detect the presence of an intruder and generate a signal in response, the controller being programmed to receive the signal from the detecting system and send an activation signal to the valve to regulate and control fluid movement through the valve and to the nozzle, and to deliver information related to the signal from the detecting system and the activation signal to third party devices.

2. The distracting module system of claim 1, wherein the nozzle is sized and configured to be concealed within a building.

3. The distracting module system of claim 1, wherein the fluid is non-aeriated cold water.

4. The distracting module system of claim 3, wherein the fluid includes an irritant mixed with the cold water.

5. The distracting module system of claim 1, wherein the fluid valve is configured to be in fluid communication with a fire sprinkler system of a building.

6. The distracting module system of claim 1, wherein the fluid valve is configured to be in fluid communication with a domestic water supply system of a building.

7. The distracting module system of claim 1, wherein further comprising at least one deterrent metering device.

8. The distracting module system of claim 7, wherein the deterrent metering device is configured to disperse a forensic dye.

9. The distracting module system of claim 7, wherein the deterrent metering device is configured to disperse a chemical deterrent.

10. The distracting module system of claim 1, wherein the detecting system includes at least one of a proximity sensor device, an audible noise detection device and a motion sensor device electronically connected to the controller.

11. The distracting module system of claim 1, wherein the detecting system includes a manual activation device configured to be activated by an occupant of a building.

12. The distracting module system of claim 11, wherein the manual activation device is configured to be disposed in a hallway or room of a building so as to enable the occupant to activate the system upon visually identifying the intruder.

13. The distracting module system of claim 1, wherein the detecting system includes a gunshot detection device electronically connected to the controller, the gunshot detection device being located in a building so as to be capable of detecting and identifying a gunshot signature and transmitting a gunshot detection signal to the controller identifying the location the gunshot.

14. The distracting module system of claim 1, wherein the nozzle is sized and configured to be concealed in a ceiling, door frame, or a counter of a building.

15. The distracting module system of claim 1, wherein the nozzle is sized and configured to be concealed in an accessory to a building structure.

16. The distracting module system of claim 15, wherein the accessory to the building structure is a light fixture or hanging pendant.

17. The distracting module system of claim 1, wherein the detecting system includes a surveillance camera.

18. The distracting module system of claim 1, further comprising a pressure indicator in fluid communication with the tank.

19. The distracting module system of claim 1, further comprising a pressure switch in fluid communication with the tank.

20. A method of deterring an intruder in a building, comprising:

detecting the intruder in a location of the building with a detecting system;

transmitting a signal generated by the detecting system to a controller;

transmitting an activation signal, via the controller, to activate a nozzle;

spraying fluid from a tank that is pressurized by a compressed gas cushion in the location of the intruder to deter the intruder; and transmitting an alert signal to a third party device, via the controller.

* * * * *